US007135105B2

(12) United States Patent
Zeng et al.

(10) Patent No.: US 7,135,105 B2
(45) Date of Patent: Nov. 14, 2006

(54) PYROLYSIS FURNACE WITH NEW TYPE HEAT SUPPLY AND METHOD OF HIGH TEMPERATURE CRACKING USING THE SAME

(75) Inventors: Qingquan Zeng, Beijing (CN); Guoqing Wang, Beijing (CN); Shixing Xu, Beijing (CN); Zhaobin Zhang, Beijing (CN)

(73) Assignees: China Petroleum & Chemical Corporation, Beijing (CN); Beijing Research Institutue of Chemical Industry, Beijing (CN)

( * ) Notice: Subject to any disclaimer, the term of this patent is extended or adjusted under 35 U.S.C. 154(b) by 555 days.

(21) Appl. No.: 10/246,473

(22) Filed: Sep. 19, 2002

(65) Prior Publication Data

US 2003/0066782 A1 Apr. 10, 2003

(30) Foreign Application Priority Data

Sep. 19, 2001 (CN) ..... 01 1 41773

(51) Int. Cl.
*C07C 4/04* (2006.01)
*F28D 7/00* (2006.01)

(52) U.S. Cl. ..... 208/106; 585/648; 422/198; 422/200

(58) Field of Classification Search ..... 422/198, 422/200; 196/116; 208/106; 585/648
See application file for complete search history.

(56) References Cited

U.S. PATENT DOCUMENTS 2,112,224 A 3/1938 Alther
2,415,726 A * 2/1947 Bogk ..... 196/116
3,841,274 A * 10/1974 Barnes ..... 122/356
4,342,642 A 8/1982 Bauer et al.
4,361,478 A 11/1982 Gengler et al.
4,454,839 A * 6/1984 Gater et al. ..... 122/333
4,879,020 A 11/1989 Tsai
4,999,089 A 3/1991 Nakase et al.
5,151,158 A 9/1992 Bowen et al.
5,181,990 A 1/1993 Arisaki et al.
6,685,893 B1 * 2/2004 Platvoet et al. ..... 422/198
2003/0066782 A1 * 4/2003 Zeng et al. ..... 208/106

FOREIGN PATENT DOCUMENTS

CN 1068587 A 2/1993

* cited by examiner

*Primary Examiner*—Glenn Caidarola
*Assistant Examiner*—Prem C. Singh
(74) *Attorney, Agent, or Firm*—Birch Stewart Kolasch & Birch, LLP

(57) ABSTRACT

The present invention provides a pyrolysis furnace with new type heat supply and a method of high temperature cracking using the same. The present invention employs top burners and bottom burners combined heat supply; the inlet of crossover section is connected from middle-upper portion of side wall of radiant section wall; and the present invention has the feature of uniform heat supply, high effectiveness, flexible and simple operation and control, and small investment, it is suitable for cracking reaction of hydrocarbons feedstock.

17 Claims, 3 Drawing Sheets

PYROLYSIS FURNACE WITH NEW TYPE HEAT SUPPLY AND METHOD OF HIGH TEMPERATURE CRACKING USING THE SAME

This nonprovisional application claims priority under 35 U.S.C. § 119 (a) on Patent Application No. 01141773.0 filed in China on Sep. 19, 2001, which is herein incorporated by reference.

BACKGROUND OF THE INVENTION

1. Field of the Invention

The invention relates to a pyrolysis furnace and a method of high temperature cracking using the same, more specifically, relates to a pyrolysis furnace with new type heat supply for high temperature cracking reaction of hydrocarbons and the method of high temperature cracking using the same.

2. Description of the Prior Art

As is known to all, the pyrolysis reaction of hydrocarbons is main means for production of very important industrial raw materials such as ethylene, propylene, etc. Even if a little improvement occurs in this field, it can bring about giant economic and social benefits. Pyrolysis furnace is the main equipment for performing high temperature cracking, therefore, nearly all chief hydrocarbons and petro-chemical companies of the world pay great attention to and not hesitate to make huge amount of investment for modification of pyrolysis furnaces.

As is understood to a person skilled in the art, high temperature condition of cracking reaction is achieved by heat supply from burners to radiation tubes in the radiant section. According to the mounting location in the radiant section, the burners are sorted into bottom burners, wall burners, and top burners, where in the bottom and top burners employ both gas and liquid fuel for burning, as well as they are also in the form of gas-liquid combined burners, Now, there are 3 kinds of arrangement of radiant tubes, namely, single row, double row and staggered row. Above mentioned content is available from reference to <<The technology of ethylene>>, by Chen Bing, (chemical industrial pub. house, 1997. chapter 4)

In U.S. Pat. No. 4,361,478 the campany LINDE discloses a Pyrolysis furnace entirely employing heat supply by means of wall burners. the pyrolysis furnace solely employing heat supply by means of wall burners has the feature of uniform temperature distribution in furnace chamber, small width of furnace chamber, etc, but too many burners are located in whole pyrolysis furnace, distribution piping of fuel is complicated, investment is large, and the operation and maintenance in practice is an expensive matter.

In U.S. Pat. No. 4,999,089 the Japanese company MITSUI discloses a pyrolysis furnace entirely employing heat supply by means of top burners. At that invention, the structure of radiant section is irregular, the form of fuel current in furnace chamber is complicated, moreover, the heated wall at radiant section is tilted, under the condition of high temperature operation, the isolation lining materials of heater wall are easy to be break-up in operation, it results in great amount of repair. Be walls, the outlet of fuel gas is located at bottom portion of radiant section, the high-powered extraction fan is needed for back current of fuel gas in radiant section, such furnace has increased cost and energy consumption.

In U.S. Pat. No. 5,151,158, the company Stone & Webster describes a pyrolysis furnace with entire heat supply from bottom burners, it wholly use heat supply from bottom burners. it is advantageous in simple operation and minimum amount of maintenance. But the requirement to burners is relative high, when the height of furnace chamber at radiant section is higher, it is necessary to have some burners of special design to meet uniform temperature requirement in furnace chamber. These burners are complex in manufacture and expensive.

In U.S. Pat. No. 4,342,642 the company LUMMUS discloses a pyrolysis furnace with bottom-wall-combined heat supply, although this kind of heat supply can partly compensate the shortage of a low height of flame of entire bottom burners, complexity of distribution piping and poor flexibility of fuel of entire wall burners, it still need for appropriate wall-to bottom burning ratio to satisfy temperature uniformity of furnace chamber. Moreover, this heat supply still based upon side wall burners, wherein a series of problems, such as complicated fuel distribution piping, large investment, complicated operation, and difficult maintenance are still presentation.

Above mentioned pyrolysis furnace of prior art generally comprising: a convection section, used for preheating the hydrocarbons feed stock; a radiant section, used for high temperature cracking hydrocarbons feedstock; and a crossover section, connected between the convection section and radiant section. A typical pyrolysis furnace with bottom burners is shown in FIG. 5, wherein bottom burners 8 and radiant tubes 7 are arranged in a radiant section 3, a convection section 2 is located above the radiant section and axially shifted, wherein convection tubes 1 are arranged, a crossover section 6 is passed horizontally from top portion of radiant section 3 to connect with bottom portion of convection section 2. The above mentioned pyrolysis furnace of prior art has greater overall height, it increases design and technology difficult and results in larger amount of capital expenditure.

Besides, the structure and arrangement of radiant tubes is another factor affecting the cracking reaction result. The radiant section of traditional vertical pyrolysis furnace inmost cases employs single row tubes to ensure uniform heat receipt of radiant tubes. There are some companies, for the purpose to obtain larger productivity of single furnace under lower investment, employ double row tubes, and for combined feature of both single and double row arrangements, employ staggered row tubes.

The radiant tubes employing single row arrangement in radiant section receive double-wall radiation; they have the most uniform heat receiving and best heat conducting effect. But the disadvantage is that in same area the number of tubes capable to be arranged is minimum, the productivity of specific area is low. Under this condition of single row arrangement, in order to meet the requirement of magnification of pyrolysis furnace, we have to extend the length of every radiant tubes and the length of radiant section, an in exorable result is that we have to greatly increase the height and length of radiant section and meet the more severe requirement for uniform heat supply by burners in radiant section At the same time, extremely long radiant tube makes the engineering problems complicated. Therefore, the use of single row arrangement structure significantly limits the productivity of pyrolysis furnace.

Although the use of double row of radiant tubes arrangement can increase the productivity by 70%, but the mutual overlap between tubes of double row seriously effects heat conductivity of heater wall from its radiation, this results in worse conductive effect from radiation. At the same time non-uniform heat receipt of radiant tubes brings about disadvantageous effect to cracking selectivity, run length and lifetime of radiant tubes.

Although the use of staggered row arrangement can partly increase productivity and uniformity of heat receipt, but in order to ensure uniformity of radiant heat conduction, the pitch between adjacent radiant tubes must be not lower than 1.8 times of outer diameter thereof, therefore, the space saved within furnace chamber is limited, Be walls, In order to avoid mutual cross-link of radiant tube bends in adjacent groups and manifolds in lower portion of furnace chamber, we have to locate the bends of adjacent groups and manifolds at different heights or different planes, this leads to two by-effects: at one hand, the radiant tubes, located at different heights, having different overall lengths in various groups, thus re retain time and severity of feedstock is different in various groups, this makes certain limitation to the optimization controlling; At the other hand, the bends and manifolds located at different planes give significant affectation to stress of all radiant tubes, which easy to cause deformation of radiant tubes. Moreover, this leads to a complicated design of radiant tube, bends and manifolds; an increased types of them, a bad interchangeability of them, high difficulty in mounting and increased investment.

FIG. 6 shows an arrangement of prior art within which two pass branched radiant tubes 7 with different diameters of type 2-1 are arranged in radiant section 3, wherein the first pass and second pass tubes are located in the same plane, that is a single row arrangement. It can be seen from the figure, although the tubes uniformly receive heat, but in total not so many tubes are arranged in radiant section, the space utilization ratio is not high, as well as the arrangement of tubes is not symmetrical and tube lengths are not the same, this leads to different working conditions of cracking process in various tubes, and thus the cracking effect is affected.

To sum up, although all the furnaces of prior art have their advantages, but also have many shortages and problems. Therefore, it is necessary to seek for a pyrolysis furnace of new type with excellent compositive properties, to overcome above described shortages.

SUMMARY OF THE INVENTION

The object of the present invention is to provide a pyrolysis furnace with new type heat supply, which has the feature of simple operation, excellent heat supply and conduction, small investment, easy maintenance, and flexible control.

In order to realize above object, the inventor has carried out a great deal of careful investigation and found that employ of top and bottom burners combined heat supply, which never has been used by others, as well as employ of new type furnace chamber structure is effective means to solve abovementioned problems.

The present invention provides a pyrolysis furnace with new type heat supply, comprising vertically arranged radiant section, in which burners and groups of radiant tubes are arranged for high temperature cracking hydrocarbons feedstock; vertically arranged convection section, located above the radiant section and axially shifted there with, in said convection section groups of convection tubes are arranged for preheating the hydrocarbons feed stock; horizontally arranged crossover section, connected between said radiant section and said convection section, characterized in that in said radiant section simultaneously top burners and bottom burners are arranged, moreover, said crossover section is extended out from a wall middle-upper portion of the radiant section and connected to the bottom portion of the convection section.

In the pyrolysis furnace, according to the present invention, the location of crossover section can be determined by the top/bottom burners' heat supply ratio R of different pyrolysis furnaces. When the ratio R varies in a range of 1:9~7:3, the top wall of crossover section is located under the top wall of radiant section, its distance H is 10%~50% of total height of radiant section wall; preferably, R varies in a range of 2:8~6:4, H is 10%~40% of total height of radiant section wall; more preferably, R varies in a range of 2.5:7.5~5:5, H is 15%~40% of total height of radiant section wall; most preferably, R varies in a range of 3:7~4:6, H is 20%~40% of total height of radiant section wall.

In the pyrolysis furnace, according to the present invention, a new type arrangement of radiant tubes can also be used, wherein said groups of radiant tubes are two pass tubes with different diameters, the first pass tubes and second pass tubes are located at two parallel planes, moreover, the projection of each second pass tube is corresponding to the center location of projection connecting line of two first pass tubes adjacent therewith, the structure of each first pass tube and second pass tube is the same.

A further object of present invention is to provide a method of high temperature cracking hydrocarbons feed stock by means of said pyrolysis furnace, including: introducing fuel gas, by pass through crossover section, from a middle-upper portion of side wall of radiant section into convection section; at convection section preheating the hydrocarbons feedstock in convection-tubes by means of fuel gas from radiant section; at radiant section high temperature cracking the preheated hydrocarbons feedstock by means of heat supplied by top and bottom burners. According to the requirement for high temperature cracking of different feedstock, in the present invention we can control the heat supply ability of said bottom burne constant, and regulate the heat supply ability of said top burner within a small range, to satisfy different outlet temperature requirement for cracking different kinds of feedstock.

BRIER DESCRIPTION OF DRAWINGS

The present invention will be better understood through describing by reference to the following drawings, in which.

DETALLED DESCRIPTION OF PREFERRED EMBODIMENTS

Figure 1:
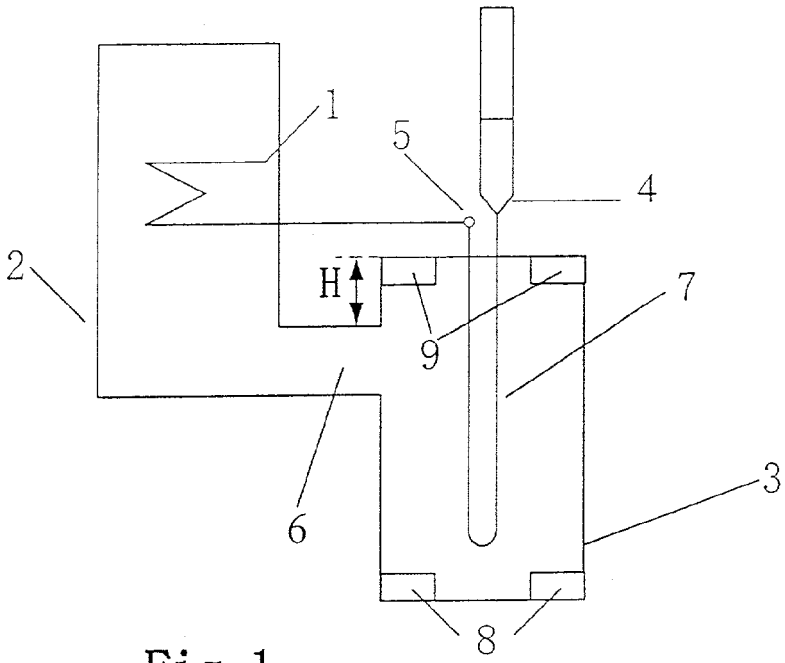
FIG. 1 is a diagrammatic elevation view of a new type pyrolysis furnace according to the present invention.

As FIG. 1 shows, the new type pyrolysis furnace of this invention comprising:

radiant section 3; bottom burners 8, arranged in radiant section 3; groups of radiant tubes 7 which can be of different structures vertically arranged in radiant section; convection section 2, located above and vertically shifted from radiant section 3; groups of convection tubes 1 in convection section of furnace, horizontally arranged in convection section 2; crossover section 6, horizontally arranged between radiant section 3 and convection section 2.

The present invention further comprising top burners 9, arranged in radiant section 3; cross over section 6, located at middle-upper portion of wall of radiant section 3.

The feedstock for cracking is introduced from the convection tubes 1 in convection section of furnace pass through the crossover tube 5 of radiant tubes 7, then, successively pass through various pass tubes of radiant tubes 7 into the transfer line exchanger 4.

The location of crossover section 6 of present invention can be determined in accordance with top/bottom burners heat supply ratio R.

When R varies in a range of 1:9~7:3, the top wall of crossover section is located under the top wall of radiant section, its distance H is 10%~50% of total height of radiant section wall; preferably, R is varied in a range of 2:8~6:4, H is 10%~40% of total height of radiant section wall; more preferably, R is varied in arrange of 2.5:7.5~5:5, H is 15%~40% of total height of radiant section wall; most preferably, R is varied in a range of 3:7~4:6, H is 20%~40% of total height of radiant section wall. In a pyrolysis furnace according to a preferred embodiment of this invention, said top burners and bottom burners can be used to supply all heat need for high temperature cracking. Top burners and bottom burners may be, preferably, combined oil-gas burners.

According to a preferred embodiment of this invention, said pyrolysis furnace can employ top burners and bottom burners of same amount. The top or bottom burners may be arranged symmetrically about centerline of top or bottom portion, the ratio of numbers of top/bottom burners is equal to 1, and corresponding to one another at top and bottom portions The top/bottom burners heat supply ratio R can be controlled by controlling the top/bottom burners fuel feeding ratio.

A pyrolysis furnace according to a prefer real embodiment of this invention, wherein the used top burners and bottom burners may be burners of various kinds as known to a person skilled in the art. In order to reduce cost, the conventional burners are preferred.

In the high temperature cracking reaction of hydrocarbons of the present invention, the hydrocarbons feedstock passes through multi-path convection tubes 1, horizontally extended in convection section 2 recovering the heat of fuel gas and after preheated to crossover temperature, the hydrocarbons feedstock passes to crossover tube 5 of convection tubes 1, after distributing an appropriate current by distributor, successively passes through tubes of various passes of radiant tubes 7, the cracked product is heat-exchanged in transfer line exchanger 4.

In can be seen from FIG. 1, the pyrolysis furnace is fully based on the heat supplied by bottom burners 8 and top burners 9, and at same time the fuel gas, produced from top and bottom burners passes through horizontally arranged crossover section 6, providing the convection heat to convection section 2. Because the top burners employ both liquid and gas fuels, or may be an oil-gas combined burners, as compared with the wall burners heat supply or bottom-wall burners combined heat supply, the present invention can reduce the number of burners, so as to reduce the investment and simplify the structure of pyrolysis furnace; as compared with entirely bottom heat supply, the fire duty of every burner is small and the NOx in fuel gas is minimum, this conforms to requirement of environment protection.

Moreover, the present invention can fully use the conventional burners, as top and bottom burners thereof. The conventional burners are inexpensive and simple in operation and maintenance.

Besides, due to employ of top and bottom burners combined heat supply, the temperature distribution in radiant section 3 is relatively uniform, at the same time the top/bottom burners heat supply ratio R can be adjusted in period of design according to the clients requirements, thus the design flexibility is greatly increased; in addition, employ of top and bottom burners combined beat supply of this invention, the outlet of fuel gas of crossover section 6, which is located at top portion of radiant section 3 of traditional art, is shifted down to middle-upper portion of radiant section 3. This not bring about negative influence on the cracking effect of pyrolysis furnace, but make the height of convection section 2 to shift down, so that the overall height of pyrolysis furnace may be lowered (by 3~6 m, in average, the particular height is controlled by top/bottom burners heat supply ratio R). As a result, the center of gravity of whole pyrolysis furnace is dropped down, this reduce the capital construction cost. Moreover, in practical operation, according to the need for different outlet temperature of various fuel kinds, it can maintain the heat supply ability of bottom burners as constant, as well as regulate the heat supply ability of top burners in a small range, to satisfy respective condition, so as to greatly increase the flexibility in practical operation.

Besides, in a pyrolysis furnace with the new type heat supply of the present invention, in order to resolve the problem of radiant tubes construction, arrangement, and uniform heat receipt, said radiant tubes 7 may be two pass non-branched tubes with different diameters (type 1-1) or two pass branched tubes with different diameters (type 2-1, 4-1, etc), wherein the two pass branched tubes with different diameters (type 2-1) are particularly preferred.

Figure 2:
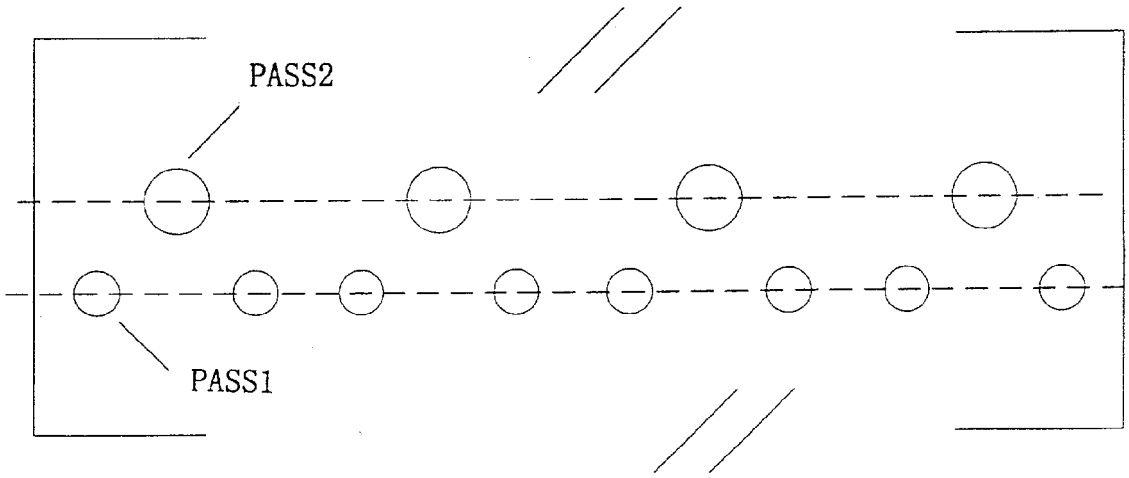
FIG. 2 is a top view of radiant section of pyrolysis furnace according to the present invention, as an example, the radiant tubes are type 2-1.
Figure 3:
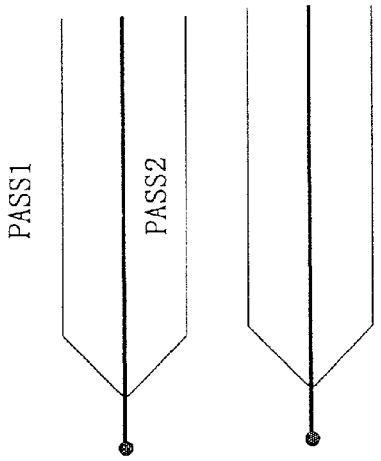
FIG. 3 is an elevation view of FIG. 2 wherein 2 groups of radiant tubes are shown.
Figure 4:
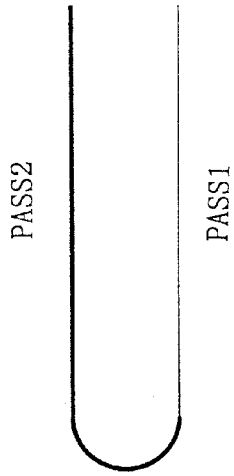
FIG. 4 is a side view of FIG. 2.
Figure 5:
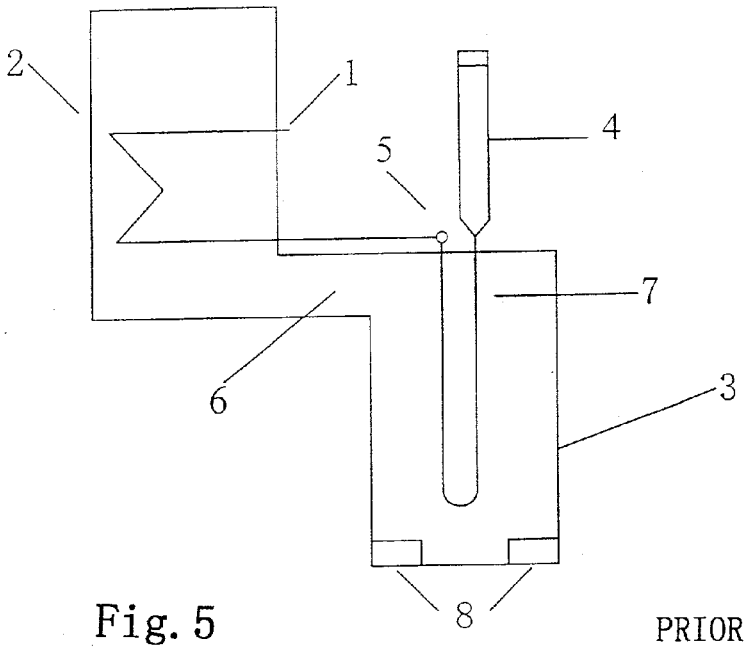
Fig. 5 PRIOR ART
FIG. 5 is a diagrammatic view of a typical pyrolysis furnace employing bottom burners heat supply in the prior art.
Figure 6:
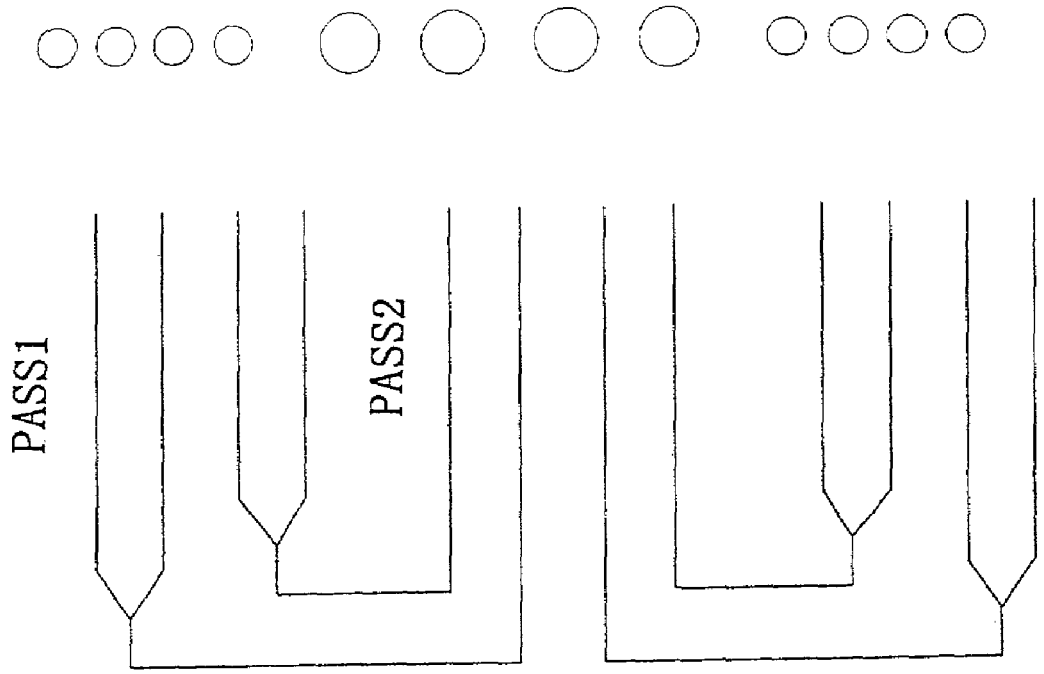
Fig. 6 PRIOR ART
FIG. 6 is a diagrammatic top view and elevation view of a single row arrangement of radiant tubes in a pyrolysis furnace in the prior art.

FIG. 2–FIG. 4 is top or elevation or side view of radiant section of pyrolysis furnace according to present invention, as an example, the radiant tubes are type 2-1.

All the abovementioned first pass and second pass tubes of radiant tubes 7 are located at two parallel planes A,B respectively, and the projection of each second pass tubes is corresponding to the center location of projection connecting line of two first pass tubes adjacent therewith, thus the mutual overlap of tubes in two rows can be avoided. wherein the pitch between two adjacent radiant tubes 7 in said same plane is 1.8~6.0 times of outer diameter of the radiant tubes, preferably 1.8~4.2 times, more preferably 2.0~2.8 times; the distance between the planes where the first pass tubes and second pass tubes are located is 100~600 mm, preferably 200~500 mm, most preferably 300~400 mm.

The bends of radiant tubes of radiant section in various groups and manifold are parallel each other without cross-link, this has no influence on radiant heat conduction of radiant tubes 7 in various groups, simultaneously, the form and weight of bends of radiant tubes 7 in various groups and manifold are fully the same, these components have high versatility, and are simple for manufacture and maintenance; the overall length of radiant tubes of radiant sections in various groups are fully the same, the retained time and pressure drop of feedstock are fully the same, which is easy to optimization of operation and control; the weight of radiant tubes of radiant sections in various groups is fully the same, this makes the balance and suspension system easy to be arranged and regulated. Because this arrangement can reduce the length of pyrolysis furnace, it is suitable to various traditional or new type transfer line exchangers Hereafter, the present invention will be described in more detail by way of examples, however, these examples are not intended to refer as limitations for this invention.

To those skilled in the art, various changes and modifications can be made, depending on its inspiration, obtained from detailed description of present invention, for example, the pyrolysis furnace employing a common convection section for two or more radiant sections; also for example, the pyrolysis furnace employing structure of furnace chamber according to the preset invention, but, the arrangement of tubes in furnace is traditional single row, double row or straggled row or other new type. All these apparent changes are within the scope of the present invention.

EXAMPLE 1

A pyrolysis furnace has the yield of ethylene 100 kiloton per year. Said pyrolysis furnace comprising: a radiant section with furnace chamber height of about 17 m; a convection section, shifted from radiant, section with height about 15 m; a cross over section horizontally arranged, and extended between said radiant and convection sections, the upper edge of crossover section is located about 6 m below from the top portion of radiant section furnace chamber; 24 top burners, arranged symmetrically about the center line of top portion, and 24 bottom burners, arranged symmetrically about the center line of bottom portion; multiple groups of convection tubes, horizontally arranged in convection section, and 48 groups of radiant tubes (type 2-1), vertically arranged in radiant section.

Because the location of crossover section is shifted down about 6 m, the over all height of furnace is cut down about 6 m. As a comparison the former pyrolysis furnace of the same scale, employing wall and bottom burners combined heat supply, has to be provided with 24 bottom burners and 48 side wall burners.

During high temperature cracking by means of said apparatus, controlling the top/bottom burners heat supply ratio R=3:7, so as to lead heat load of radiant section to arrive 80~100 MW, the Naphtha or Hydrogenated Vacuum Gas oil and dilution steam mixture passes through multi-path convection tubes 1, horizontally extended in convection section 2, after recovering the heat of fuel gas in convection section and preheating to the crossover temperature, the hydrocarbons feed stock passes through the convection tubes 1, into crossover tube 5 after distributing an appropriate current by distributor, passes into radiant tubes 7, vertically arranged in radiant section 3, the cracked product is heat exchanged in transfer line exchanger 4. The pyrolysis furnace is fully based on the heat supply by bottom burners 8 and top burners 9, and at same time, the fuel gas, produced from top and bottom burners passes through the horizontally arranged crossover section 6, providing convection heat to convection section 2.

EXAMPLE 2

A pyrolysis furnace has the yield of ethylene 60 kiloton per year. Said pyrolysis furnace comprising: a radiant section with furnace chamber height of about 14 m; a convection section, shifted from radiant section, with height about 14 m; a cross over section, horizontally arranged and extended between said radiant and convection sections; the center of outlet of fuel gas is located about 3 m below from the top portion of radiant section in furnace chamber; 24 top burners, arranged symmetrically about the center line of top portion, and 24 bottom burners, arranged symmetrically about the center line of bottom portion; groups of convection tubes, horizontally arranged in convection section, and 32 group of radiant tubes (type 2-1), vertically arranged in radiant section. Because the location of crossover section is shifted down about 3 m, the over all height of furnace is cut down about 3 m, whereas the pyrolysis furnace of the same scale, employing wall and bottom burners combined heat supply need to comprise 24 bottom burners and 72 side wall burners.

During high temperature cracking by means of said apparatus, controlling the top/bottom burners heat supply ratio R=4:6, so as to lead the average heat intensity to arrive about 300 $Gj/m^2 \cdot h$; The naphtha and dilution steam mixture passes through the multi-path convection-tubes 1, horizontally extended in convection section 2, after recovering the heat of fuel gas in convection section the hydrocarbons feed stock passes through convection-tubes 1 into crossover tube 5, after distributing an appropriate current by distributor, passes into radiant tubes 7, vertically arranged in radiant section 3, the cracked product is heat exchanged in transfer line exchanger. The pyrolysis furnace is fully based on the heat supply by bottom burners 8 and top burners 9, and at the same the fuel gas, produced from top and bottom burners passes through the horizontally arranged crossover section 6, providing convection heat to the convection 2.

We claim :

1. A pyrolysis furnace with new type heat supply, comprising:

a) a vertically arranged radiant section (3), in which burners and groups of radiant tubes (7) are arranged for high temperature cracking hydrocarbons feedstock;

b) a vertically arranged convection section (2), located above the radiant section and axially shifted therewith, in said convection section groups of convection tubes (1) are arranged for preheating the hydrocarbons feedstock; and c) a horizontally arranged crossover section (6), connected between said radiant section (3) and said convection section (2);

wherein, both top burners (9) and bottom burners (8) are arranged in said radiant section (3), and said crossover section (6) is extended out from a middle-upper portion of a side wall of the radiant section (3) and connected to a bottom portion of the convection section (2), and a top wall of said cross over section (6) is located under a top wall of said radiant section (3), a distance H between the two top walls is determined by the top/bottom burners' (9,8) heat supply ratio R, such that when R varies in a range of 1:9–7:3, the distance H is in a range of 10%–50% of a total height of the radiant section (3).

2. The pyrolysis furnace according to claim 1, wherein when R varies in a range of 2:8–6:4, the distance H is in a range of 10%–40% of the total height of the radiant section (3).

3. The pyrolysis furnace according to claim 2, wherein when the R varies in a range of 2.5:7.5–5:5, the distance H is in a range of 15%–40% of the total height of the radiant section (3).

4. The pyrolysis furnace according to claim 3, wherein when R varies in a range of 3:7–4:6, the distance H is in a range of 20%–40% of the total height of the radiant section (3).

5. The pyrolysis furnace according to claim 1, wherein a number of said bottom burners (8) is equal to a number of said top burners (9), and the top or bottom burners are arranged symmetrically about a centerline of top or bottom portions and correspond to one another at the top or bottom portions respectively.

6. The pyrolysis furnace according to claim 1, wherein said groups of radiant tubes (7) are two pass tubes with different diameters, within which first/second pass tubes in various groups are respectively located at first/second planes parallel each other, a projection of each second pass tube is corresponding to a center location of a projection connecting line of two first pass tubes adjacent therewith, and said first/second pass tubes have a same diameter and structure.

7. The pyrolysis furnace according to claim 6, wherein said radiant tubes (7) are type 2-1 of two pass branched tubes with different diameters.

8. The pyrolysis furnace according to claim 6, wherein said radiant tubes (7) are type 4-1 of two pass branched tubes with different diameters.

9. The pyrolysis furnace according to clam 6, wherein said radiant tubes are type I-1 of two pass non-branched tubes with different diameters.

10. The pyrolysis furnace according to claim 7, wherein a pitch between two adjacent radiant tubes (7) at the same plane is 1.8–6.0 times of an outer diameter of radiant tubes at the same plane.

11. The pyrolysis furnace according to claim 7, wherein a pitch between two adjacent radiant tubes (7) at the same plane is 1.8–4.2 times of an outer diameter of radiant tubes at the same plane.

12. The pyrolysis furnace according to claim 7, wherein a pitch between two adjacent radiant tubes (7) at the same plane is 2.0–2.8 times of an outer diameter of radiant tubes at the same plane.

13. The pyrolysis furnace according to claim 7, wherein a distance between said first and second planes is 100–600 mm.

14. The pyrolysis furnace according to claim 7, wherein a distance between said first and second planes is 200–500 mm.

15. The pyrolysis furnace according to claim 7, wherein a distance between said first and second planes is 300–400 mm.

16. A method of high temperature cracking hydrocarbons feedstock by means of the pyrolysis furnace according to claim 1, which comprises the steps of:

(A) at convection section (2), preheating the hydrocarbons feed stock in convection tubes (1) by utilizing fuel gas from radiant section (3);

(B) at radiant section (3), high temperature cracking the preheated hydrocarbon feedstock in radiant tubes (7) by utilizing the heat supplied by top burners (9) and bottom burners (8), and (C) regulating a heat supply by top burners (9) while maintaining a constant heat supply by bottom burners (8) so as to satisfy a temperature requirement for cracking different hydrocarbons feedstock.

17. A method for high temperature cracking hydrocarbons, which comprises:

heating said hydrocarbons in the pyrolysis furnace according to claim 1.

* * * * *